United States Patent [19]

Voorman

[11] Patent Number: 4,629,973

[45] Date of Patent: Dec. 16, 1986

[54] CURRENT STABILIZING CIRCUIT OPERABLE AT LOW POWER SUPPLY VOLTAGES

[75] Inventor: Johannes O. Voorman, Eindhoven, Netherlands

[73] Assignee: U.S. Philips Corporation, New York, N.Y.

[21] Appl. No.: 626,344

[22] Filed: Jun. 29, 1984

[30] Foreign Application Priority Data

Jul. 11, 1983 [NL] Netherlands ..... 8302458

[51] Int. Cl.[4] ..... G05F 1/56

[52] U.S. Cl. ..... 323/316; 323/312

[58] Field of Search ..... 323/312, 314, 315, 316; 307/296 R, 297; 330/257, 288

[56] References Cited

U.S. PATENT DOCUMENTS 3,914,683 10/1975 van der Plassche ..... 323/316

4,412,186 10/1983 Nagano ..... 323/316

*Primary Examiner*—Clifford C. Shaw

*Attorney, Agent, or Firm*—Robert T. Mayer; Steven R. Biren

[57] ABSTRACT

Arranged between a first and a second common terminal, the circuit includes a first circuit formed by the series arrangement of a first PNP-transistor and a second NPN-transistor, and a second circuit formed by the series arrangement of a third PNP-transistor, a fourth NPN-transistor and a first resistor. The commonly-connected bases of the second and fourth transistors are driven by a first differential amplifier, whose non-inverting input is coupled to the collector of the second transistor and whose inverting input is coupled to a tap of a voltage divider formed by a second and a third resistor. The commonly-connected bases of the first and third transistors are driven by a second differential amplifier, whose non-inverting input is coupled to the collector of the third transistor and inverting input to the tap of the voltage divider. Because of the drive by means of the first and second amplifiers, the collector-base voltages of the first and third transistors and of the second and fourth transistors vary to an equal extent in the event of supply voltage variations, as a consequence of which the symmetry of the circuit is preserved.

3 Claims, 10 Drawing Figures

CURRENT STABILIZING CIRCUIT OPERABLE AT LOW POWER SUPPLY VOLTAGES

SUMMARY OF THE INVENTION

The invention relates to a current stabilizing circuit including first and second circuits arranged in parallel between first and second common terminals, the first circuit being formed by the series arrangement of the collector-emitter path of a first transistor of a first conductivity type and the collector-emitter path of a second transistor of a second conductivity type, the second circuit being formed by the series arrangement of the collector-emitter path of a third transistor of the first conductivity type, the collector-emitter path of a fourth transistor of the second conductivity type and a resistor, the first and third transistors having commonned control electrodes and the second and fourth transistors having commonned control electrodes which are driven by an output of a differential amplifier having a first and a second input, the first input being coupled to the first circuit between the first and second transistors.

Such a current stabilizing circuit can, for example, be used in an integrated filter circuit of a type which is assembled from transconductors and capacitors. Such filter circuits are, for example, described in IEEE Journal of Solid-State Circuits SC-17, 713–722 "Integration of analog filters in a bipolar process".

Such a current stabilizing circuit is derived from a current stabilizer of a generally known type, in which the first and third transistors form part of a current mirror circuit which in the case of equal emitter areas of these transistors effects mutually equal currents in the first and second circuits. The magnitude of these currents is determined by the resistance value of the resistor and the ratio between the emitter areas of the second transistor which is connected as a diode and the fourth transistor. Instead of equal currents it is alternatively possible to maintain unequal currents in the first and second circuits by choosing the ratio between the emitter areas of the first and third transistors unequal.

A current stabilizing circuit of the type set forth above is known from FIG. 2 of U.S. Pat. No. 3,914,683. Therein the current mirror circuit is formed by a three-transistor current mirror. The first transistor is connected as a diode. Arranged in series with the collector-emitter path of this transistor is the collector-emitter path of an additional transistor whose control electrode is connected to the collector of the third transistor. In this circuit the second transistor is not connected as a diode, but the base current for the second and fourth transistors is supplied from the output of a differential amplifier, one input of which is connected to the collector of the second transistor and the other input to the collector of the fourth transistor. The differential amplifier ensures that the collector-base voltages of the second and fourth transistors are always equal, so that in the event of supply voltage variations these collector-base voltages vary in an identical way, and consequently retroact in an identical way on the base-emitter voltages (compensation for the Early-effect), so that the symmetry of the circuit is not influenced and the ratio between the currents in the first and second circuits is maintained. As the inputs of the differential amplifier are also present across the collector-base junction of the additional transistor, the collector-base voltage of this transistor is also substantially independent of variations in the supply voltage.

A disadvantage of this prior art current stabilizing circuit is that because of the voltage required for the additional transistor of the current-mirror circuit it is not suitable for very low supply voltages of approximately 1 V. It is, however, possible to omit the additional transistor, so that only the first and third transistors form the current-mirror circuit, it then being necessary to connect the third transistor as a diode. A disadvantage thereof is that the base current for the first and third transistors is withdrawn from the second circuit, as a result of which the mirror ratio of the current-mirror circuit is disturbed and the currents through the two circuits are no longer accurately equal to each other. A further disadvantage is that current sources which are derived from the current stabilizing circuit by providing transistors whose base-emitter junctions are in parallel with the base-emitter junction of the first transistor are not compensated for the Early-effect.

SUMMARY OF THE INVENTION

The invention has for its object to provide a current stabilizing circuit which evidences a good supply voltage suppression and continues to operate very accurately at very low supply voltages. According to the invention, a circuit of the type specified above is characterized in that the commonned control electrodes of the first and third transistors are driven by an output of a second differential amplifier having a first and a second input, the first input being coupled to the second circuit between the third and fourth transistors, that a voltage divider is included between the first and second common terminals, and that the second inputs of the first and second differential amplifiers are coupled to a tap of the voltage divider. According to the invention, not only the base current of the second and fourth transistors is supplied by a differential amplifier, but also the base current of the first and third transistors is supplied by a differential amplifier, as a result of which the influence of the base currents of the first and third transistors on the current mirror effect can be significantly reduced. As one input of each of the two differential amplifiers is coupled to a current circuit and the other input to a tap of a voltage divider, the collector-base voltages of the third and first transistors and of the second and fourth transistors can be made equal so that in the event of supply voltage variations these collector-base voltages vary in the same way. This ensures the symmetry of the circuit and consequently a constant ratio between the currents in the first and second circuits.

With such a current stabilizing circuit a stabilized output current can, for example, be taken from the collector of a transistor whose base-emitter path is arranged in parallel with the base-emitter path of the first transistor and from the collector of a transistor whose base-emitter path is arranged in parallel with the base-emitter path of the second transistor. In this way such transistors form current source transistors for further circuits.

As has already been mentioned, such a current stabilizing circuit is suitable for use in integrated filter circuits assembled from transconductors and capacitors. Using these two components it is possible to realize any type of filter circuit which can be made using resistors, capacitors and coils.

In filter circuits of such a type, the transconductors may comprise a differential stage arrangement formed by two parallel-arranged differential stages which are arranged between the collectors of current source transistors of the first conductivity type, whose base-emitter paths are arranged in parallel with the base-emitter paths of the first transistor, and the collectors of current source transistors of the second conductivity type whose base-emitter paths are arranged in parallel with the base-emitter paths of the second transistor. One base-emitter junction across which there is one base-emitter voltage is then present between the collectors of two current source transistors of opposite conductivity types. In addition, one of the two inputs of each differential stage is coupled to a point of the current stabilizing circuit which serves as filter ground for the signal and carries a substantially constant voltage, for example the junction point in the second circuit between the third and fourth transistors.

As in such circuits a base-emitter junction is present between the collectors of two current source transistors of opposite conductivity types, the collector-base voltages of these current source transistors may differ from the collector-base voltages of the transistors of the current stabilizing circuit. This causes the collector-base voltages of the current-source transistors to vary in the case of supply voltage variations in a way different from that of the current stabilizing circuit. Due to the retroaction of the variations on the base-emitter voltages, the currents from the current source transistors are then no longer accurately equal to the stabilizing current in the first and second circuits of the current stabilizing circuit.

An embodiment of a current stabilizing circuit with which it can be accomplished that in the event of supply voltage variations the collector-base voltages of the derived current source transistors can vary in a way similar to that of the transistors of the current stabilizing circuit is characterized in that in at least the first and second circuits between the collector-emitter paths of respectively the first and second transistors and the third and fourth transistors at least one semiconductor junction connected in the forward direction is incorporated. Because of this measure a semiconductor junction is present in each current circuit, as a result of which the collector-base voltages can again be made equal. The inputs of the first and second differential amplifiers may be coupled to the positive or the negative pole of the semiconductor junctions in the first and second current circuits. If the inputs are both connected to corresponding poles of the respective junctions a semiconductor junction must also be included in the voltage divider. The number of semiconductor junctions to be included in the first and second circuits is determined by the precise structure of the differential stage. Namely, the input transistors of the differential stage may be in the form of a pair of Darlington transistors. In that case two semiconductor junctions must be provided in each of the circuits.

BRIEF DESCRIPTION OF THE DRAWING

The invention will now be described in greater detail by way of example with reference to the accompanying drawing, in which.

DESCRIPTION OF THE PREFERRED EMBODIMENTS

Figure 1A:
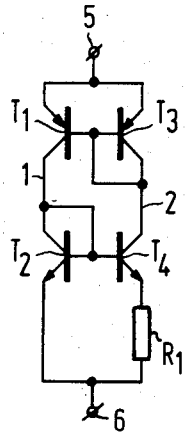
FIG.1a PRIOR ART
FIG. 1*a* shows the basic circuit diagram of a prior art current stabilizing circuit.
Figure 1B:
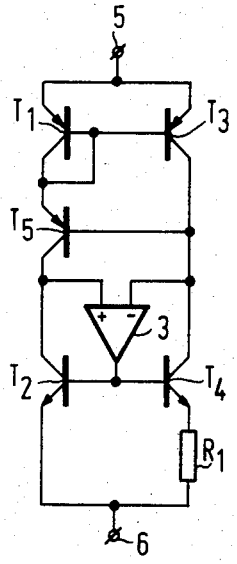
FIG.1b PRIOR ART
FIG. 1*b* shows a prior art current stabilizing circuit derived from the circuit shown in FIG. 1*a;*

FIG. 1*a* illustrates the basic circuit diagram of a known current stabilizing circuit. The circuit comprises, arranged between first and second common terminals 5 and 6, first and second parallel circuits 1 and 2. The circuit 1 is constituted by the series arrangement of a PNP-transistor $T_1$ and a diode-connected NPN-transistor $T_2$. The circuit 2 is constituted by the series arrangement of a diode-connected PNP transistor $T_3$, an NPN-transistor $T_4$ and a resistor R. The transistors $T_1$ and $T_3$, which have bases connected in common, form a current mirror. If the transistors $T_1$ and $T_3$ have equal emitter areas, this current mirror provides that equal currents flow in both current circuits. In that case the emitter area of transistor $T_4$ should be larger than that of transistor $T_2$ so as to yield a stabilized current different from zero. The magnitude of the stabilized current in both circuits is then defined by $$I = \frac{KT}{qR_1}$$

ln n, wherein k is the Boltzmann constant, T the absolute temperature, q the elementary charge and n the ratio between the emitter areas of the transistors $T_4$ and $T_2$. Instead of equal currents, unequal currents may alternatively flow through the two circuits by choosing the ratio between the emitter areas of the transistors $T_1$ and $T_3$ to be different from unity. In that case the transistors $T_2$ and $T_4$ may have equal emitter areas. In this circuit it has been found that the stabilized current is rather dependent on supply voltage variations because these variations are substantially wholly present across the collector-base junction of the transistors $T_1$ and $T_4$, whereby the symmetry of the circuit is disturbed. FIG. 1*b* illustrates such a type of current stabilizer which evidences an improved supply voltage suppression. Components identical to those in FIG. 1*a* are given the same reference numerals. The current mirror circuit is now formed by the transistors $T_1$, $T_3$ and $T_5$, the collector-emitter path of transistor $T_5$ being arranged in series with the collector-emitter path of transistor $T_1$, which is now connected as a diode. This current mirror circuit operates more accurately than the current mirror circuit shown in FIG. 1*a*, because withdrawing base current for the transistors $T_1$ and $T_3$ from the first circuit is partly compensated for by the base current of transistor $T_5$ which is withdrawn from the second circuit. The base current for the transistors $T_2$ and $T_4$ is produced by a differential amplifier 3, whose non-inverting input is connected to the collector of transistor $T_2$ and the inverting input to the collector of transistor $T_4$. The differential amplifier 3 ensures that the collector-base voltages of the transistors $T_2$ and $T_4$ are always equal and consequently vary in an identical way with supply voltage variations. At the same time the differential amplifier 3 keeps the collector-base voltage of transistor $T_5$ constant, irrespective of any supply voltage variations.

Although this circuit has a good supply voltage suppression, it is not so suitable for very low supply voltages because of the required collector-emitter voltage for transistor $T_5$. Omitting transistor $T_5$ has the disadvantage that then the symmetry of the circuit is disturbed by withdrawing the base current for the transistors $T_1$ and $T_3$ from the second circuit. In addition, it causes problems when current sources are coupled thereto whose base-emitter paths are in parallel with the base-emitter path of transistor $T_1$.

Figure 2:
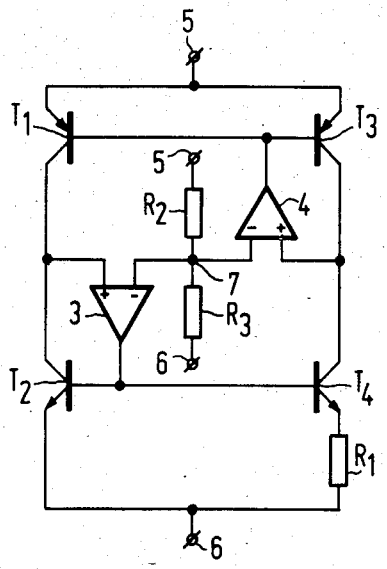
FIG. 2 shows the circuit diagram of a first current stabilizing circuit according to the invention.

FIG. 2 shows a first current stabilizing circuit according to the invention, which circuit is suitable for very low supply voltages and simultaneously evidences a satisfactory voltage suppression. Components identical to those in FIG. 1*b* are given the same reference numerals. The base currents for the transistors $T_2$ and $T_4$ are again supplied from the output of a differential amplifier 3, whose non-inverting input is coupled to the collector of transistor $T_2$. The inverting input is now however coupled to the junction point 7 of two resistors $R_2$ and $R_3$, which are included between the positive and negative supply terminals 5 and 6. The current mirror circuit is formed by only the transistors $T_1$ and $T_3$. The base current for these transistors is supplied from the output of a differential amplifier 4, whose non-inverting input is coupled to the collector of transistor $T_3$. The inverting input is also coupled to the junction point 7 of the resistors $R_2$ and $R_3$. Since both the base current for the transistors $T_2$ and $T_4$ and also the base current for the transistors $T_1$ and $T_3$ are supplied by a differential amplifier, the symmetry of the circuit is preserves, so that equal currents flow through both circuits of the current stabilizing circuit. The differential amplifiers 3 and 4 have an adequately high gain, so that the voltages at both inputs of each amplifier are equal. This accomplishes that, as is obvious from the Figure, the collector-base voltages of the transistors $T_1$ and $T_3$ and those of the transistors $T_2$ and $T_4$ are equal to each other. In the event of supply voltage variations the collector-base voltages of these transistors vary in an identical way, so that the retroaction of these variations on the collector currents of these transistors is identical. Consequently, the symmetry of the circuit is preserved in the event of supply voltage variations. In the case in which the resistors $R_2$ and $R_3$ have equal resistance values, the collector-base voltages of all the transistors $T_1$ to $T_4$ are equal. The voltage divider which is here formed by the resistors $R_2$ and $R_3$ may alternatively be formed by other impedance elements, such as capacitors.

Figure 3:
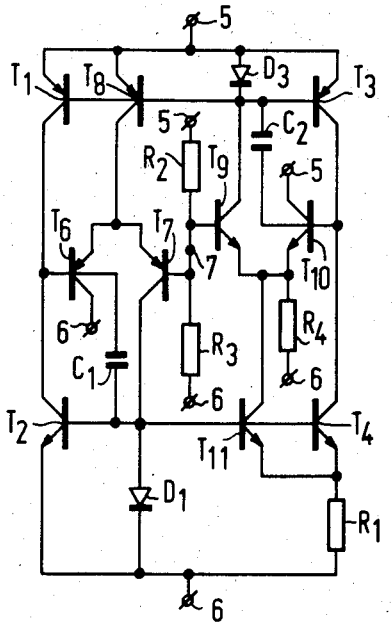
FIG. 3 shows an implementation of the circuit of FIG. 2.

FIG. 3 shows a practical implementation of the circuit of FIG. 2, in which components identical to those in FIG. 2 are given the same reference numerals. The differential amplifier 3 is formed by two PNP-transistors $T_6$ and $T_7$, in whose common emitter lead a current source is included constituted by transistor $T_8$, whose base-emitter path is arranged in parallel with the base-emitter path of transistor $T_1$. The base of transistors $T_6$ is connected to the collector of transistor $T_2$ while the collector is connected to the negative supply terminal 6. The base of transistor $T_7$ is connected to the junction point 7 between the resistors $R_2$ and $R_3$. The collector thereof is connected via a diode $D_1$ to the negative supply terminal, the anode of diode $D_1$ being connected to the commonly-connected bases of transistors $T_2$ and $T_4$. The diode may be in the form of a transistor having a shorted collector-base junction. In order to reduce the influence of the base current of the PNP-transistor $T_6$, which current is withdrawn from the first circuit, the emitter area of transistor $T_1$ is twice as large as that of transistor $T_8$ and the emitter area of the diode $D_1$ is equal to one fourth of the emitter area of transistor $T_2$. The differential amplifier 4 is formed by two NPN-transistors $T_9$ and $T_{10}$, a current source being included in the common emitter lead, which source is formed by a transistor $T_{11}$, the resistor $R_1$ being included in the emitter lead, as a result of which high-frequency instabilities are counteracted. The base of transistor $T_{10}$ is connected to the collector of transistor $T_3$ and its collector to the positive supply terminal 5. The base of transistor $T_9$ is coupled to the junction point 7 between resistors $R_2$ and $R_3$ while the collector is coupled to the positive supply terminal 5 via a diode $D_3$, whose cathode is coupled to the commonly-connected bases of transistors $T_1$ and $T_3$. In addition, connected to the common emitter lead of the transistors $T_9$ and $T_{10}$ there is a starter resistor $R_4$ which ensures that when supply voltage is applied, the circuit adjusts itself to a stabilized current different from zero. In order to prevent high-frequency instabilities, a capacitor, $C_1$ and $C_2$ respectively, is provided between the base of transistor $T_6$ and the commonly-connected bases of the transistors $T_2$ and $T_4$ and between the base of transistor $T_{10}$ and the commonly-connected bases of the transistors $T_1$ and $T_3$. It should be noted that these capacitors are not strictly necessary and may be omitted.

Figure 4:
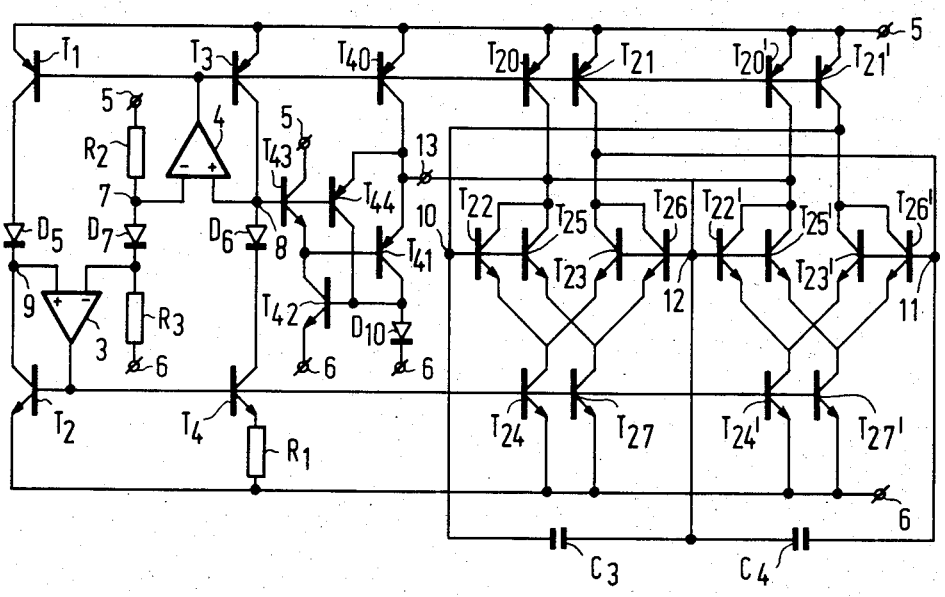
FIG. 4 shows a filter circuit comprising a second current stabilizing circuit according to the invention.

FIG. 4 shows a filter circuit comprising a second current stabilizing circuit according to the invention. Components which are the same as those in FIG. 2 are given the same reference numerals.

A diode $D_5$ is included in the current stabilizing circuit in the first circuit between the collectors of the transistors $T_1$ and $T_2$, the non-inverting input of the amplifier 3 being coupled to the cathode of the diode $D_5$. Likewise, a diode $D_6$ is included in the second circuit between the collectors of the transistors $T_3$ and $T_4$, the non-inverting input of the amplifier 4 being coupled to the anode of diode $D_6$. A diode $D_7$ is included in the voltage divider between the resistors $R_2$ and $R_3$, in such manner that the inverting inputs of amplifiers 3 and 4 are coupled to the cathode and the anode, respectively, of diode $D_7$. The diodes $D_5$, $D_6$ and $D_7$ may be constituted by transistors having shorted base-collector junctions. In this example the filter circuit is constituted by a gyrator-resonant circuit comprising two transconductance circuits which each are of an identical construction and in which the components of the second transconductance circuit which correspond to those of the first transconductance circuit are denoted by an accent notation. The first transconductance circuit is constituted by a differential stage formed by the transistors $T_{22}$ and $T_{23}$, the transistors $T_{22}$ and $T_{23}$ having unequal emitter areas. A second differential stage formed by the transistors $T_{25}$ and $T_{26}$ is arranged in parallel with the first differential stage. The ratio between the emitter areas of the transistors $T_{25}$ and $T_{26}$ is equal to the ratio between the emitter areas of the transistors $T_{23}$ and $T_{22}$. Current source transistors $T_{24}$ and $T_{27}$ respectively, whose base-emitter junctions are arranged in parallel with that of transistor $T_2$, are included in the common emitter leads of these differential stages. Current source transistors $T_{20}$ and $T_{21}$ respectively, whose collector-emitter paths are arranged in parallel with those of transistor $T_1$, are included in the common collector leads of the transistors $T_{22}$ and $T_{25}$ and of the transistors $T_{23}$ and $T_{26}$. For, for example, an emitter area ratio for the transistors $T_{22}$ and $T_{23}$ equal to 4, the transconductance G which is equal to the ratio between the signal current and the signal voltage across the inputs is given by $$G = \frac{8}{25} \frac{qI}{kT},$$

where I is the current carried by the current source transistors $T_{20}$, $T_{21}$, $T_{24}$ and $T_{27}$. The two transconductance circuits are connected as a gyrator, the bases of transistors $T_{22}$, $T_{25}$ being connected to the collectors of transistors $T_{23}'$, $T_{26}'$, the bases of transistors $T_{23}'$, $T_{26}'$ to the collectors of transistors $T_{23}$, $T_{26}$, the bases of transistors $T_{23}$, $T_{26}$ to the bases of transistors $T_{22}'$, $T_{25}'$ and to the collectors of transistors $T_{22}'$, $T_{25}'$ and $T_{22}$, $T_{25}$. The common base connection 12 of the transistors $T_{26}$ and $T_{22}'$ is coupled to the output 13 of a negative impedance converter $T_{40}$ . . . $T_{44}$, which output serves as a low-resistance filter earth for signal voltages. A capacitor $C_4$ which, as is known, is seen at the input terminals 10 and 12 of the gyrator as an inductance is arranged between the output terminals 11 and 12 of the gyrator. In addition, a capacitor $C_3$ is connected across the input terminals 10 and 12, which capacitor in combination with the inductance simulates an LC resonant circuit.

It should be noted that in addition to this LC circuit comprising transconductances and capacitors all types of filter circuits can be realized which can be assembled from conventional coils, capacitors and resistors, the transconductance circuits always being included in the same way as in this embodiment between the collectors of current source transistors.

The negative impedance converter comprises a current source transistor $T_{40}$, whose base-emitter junction is arranged in parallel with that of transistor $T_3$, which produces the emitter current for the PNP-transistor $T_{41}$. The emitter of transistor $T_{41}$ also constitutes the output 13 of the converter. The collector current of transistor $T_{41}$ is reflected by means of the current mirror circuit $D_{10}$, $T_{42}$ to the emitter of NPN-transistor $T_{43}$, which emitter is further connected to the base of transistors $T_{41}$. The collector of transistor $T_{43}$ is connected to the positive supply terminal 5, while the base of this transistor, which constitutes the input of the converter, is coupled to the point 8 in the second circuit of the current stabilizer. This circuit has the property of rendering the voltage at the output 13 independent of the signal current withdrawn from this output, that is to say the circuit has an output impedance equal to zero, as the difference between the input and output voltages, which difference is equal to the difference between the base-emitter voltages of the transistors $T_{43}$ and $T_{41}$, is only determined by the ratio between the emitter areas of the transistors $T_{41}$ and $T_{43}$ and of diode $D_{10}$ and transistor $T_{42}$ and is independent of the signal current at output 13. As the voltage at the input 8 is constant, the voltage at the output 13 is also constant. The circuit further comprises a PNP-transistor $T_{44}$, whose collector-emitter path is connected between the base of transistor $T_{42}$ and the output 13 and whose base is connected to the input. This transistor ensures that when the supply voltage is applied the circuit adjusts itself properly. It should be noted that the input of the converter may alternatively be coupled to junction point 7 or to junction point 9. Instead of a negative impedance converter other circuits having a very low output impedance may alternatively be used as a filter ground, such as an emitter follower-connected operational amplifier. As the collectors of the transistors $T_{20}$ and $T_{20}'$ are connected to point 12 and the collectors of transistor $T_{21}'$ are connected to the points 11 and 10, respectively, the circuit incorporates negative feedback. This causes an equally large quiescent current to flow through all the transistors $T_{22}$, $T_{25}$, $T_{23}$, $T_{26}$, $T_{22}'$, $T_{25}'$, $T_{23}'$ and $T_{26}'$. Consequently, the points 10, 11 and 12 carry the same d.c. voltage. From this it also follows that the collector voltages of the transistors $T_{20}$, $T_{21}$, $T_{20}'$ and $T_{21}'$ are equal.

Between the collectors of each of the transistors $T_{20}$, $T_{21}$, $T_{20}'$ and $T_{21}'$ and the collectors of the transistors $T_{24}$, $T_{27}$, $T_{24}'$ and $T_{27}'$ there is one base-emitter junction which consumes one diode voltage. The collectors of the transistors $T_{24}$, $T_{27}$, $T_{24}'$ and $T_{27}'$ therefore carry a d.c. voltage which is one diode voltage lower than the d.c. voltage of the collectors of the transistors $T_{20}$, $T_{21}$, $T_{20}'$ and $T_{21}'$. If no further measures were taken in the current stabilizing circuit, the collector-base voltages of the transistors $T_{20}$ to $T_{21}'$ would differ from those of the transistors $T_1$ and $T_3$ and the collector-base voltages of the transistors $T_{24}$ to $T_{27}'$ would differ from those of transistors $T_2$ and $T_4$. As a result thereof, in the event of supply voltage variations, the currents from the current source transistors would not be equal to those of the current stabilizing circuit because of the retroaction of these variations. Providing the diodes $D_5$, $D_6$ and $D_7$ accomplishes that the collector-base voltages of the transistors $T_{20}$ to $T_{21}'$ are equal to those of $T_1$ and $T_3$ and that the collector-base voltages of the transistors $T_{24}$ to $T_{27}'$ are equal to those of $T_2$ and $T_4$, so that they vary in the same way in the event of supply voltage variations. Given the fact that the voltages on both inputs of the amplifiers 3 and 4 are equal, it is simple to derive from the Figure that the collector-base voltage of $T_1$ is equal to that of $T_3$. For equal collector voltages of the transistors $T_3$, $T_{40}$ and $T_{20}$ it follows that the collector-base voltages of the transistors $T_{20}$ to $T_{21}'$ are equal to those of $T_1$ and $T_3$. Since the collector voltages of the transistors $T_2$, $T_4$ and $T_{24}$ to $T_{27}'$ are all one diode voltage lower than the collector voltages of the transistors $T_1$ to $T_{21}'$, it follows that then also the collector voltages of the transistors $T_2$, $T_4$ and $T_{24}$ to $T_{27}'$ are equal. It should be noted that if the resistance values of the resistors $R_2$ and $R_3$ are equal the collector-base voltages of all the transistors are equal.

Figure 5:
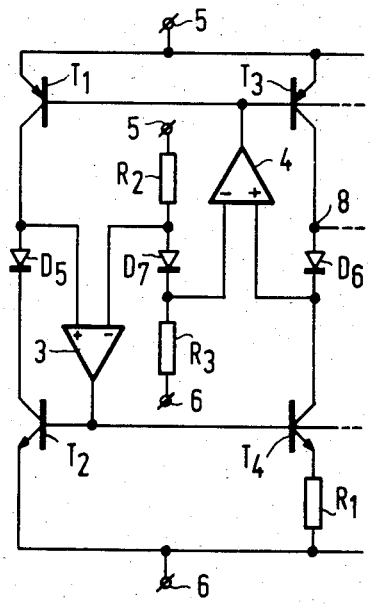
FIG. 5 shows a variation of the current stabilizing circuit of FIG. 4.

FIG. 5 shows a variation of the current stabilizing circuit shown in FIG. 4, the difference being that the non-inverting input of amplifier 3 is not connected to the cathode but to the anode of diode $D_5$ and the inverting input is not connected to the cathode but to the anode of $D_7$. Similarly, the non-inverting input of amplifier 4 is now connected to the cathode of $D_6$ and the inverting input is connected to the cathode of diode $D_7$.

Figure 6:
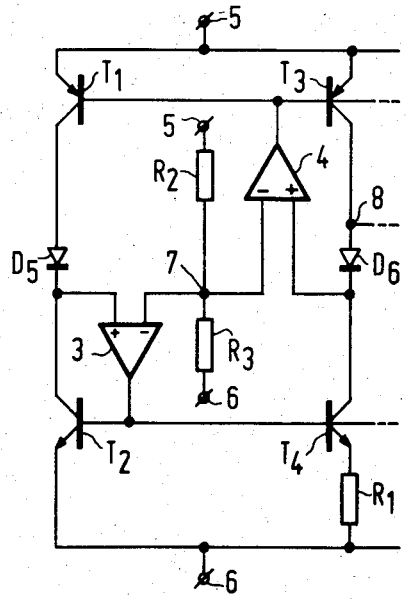
FIG. 6 shows a third current stabilizing circuit according to the invention.
Figure 7:
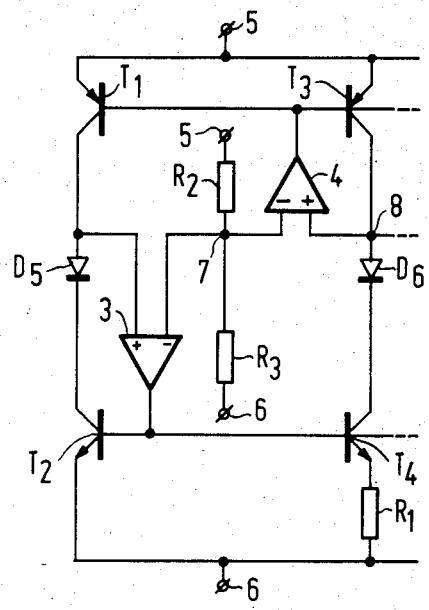
FIG. 7 shows a variation of the current stabilizing circuit of FIG. 6.

FIG. 6 shows a third current stabilizing circuit according to the invention, in which components which are the same as in FIG. 5 are given the same reference numerals. In this embodiment a diode is only provided in the first and second circuits. The non-inverting inputs of the amplifier 3 and 4 are coupled to the cathodes of the diodes $D_5$ and $D_6$, respectively, while the inverting inputs are coupled to the junction point 7 between the resistors $R_2$ and $R_3$. The input of the negative impedance converter may in this case be coupled to the first or second current circuits but not to the junction point 7 between the resistors $R_2$ and $R_3$. It should be noted that a similar result can be realized with other types of negative impedance converters. Also for this circuit it holds that the collector-base voltages of all the current source transistors are equal to those of the transistors of the current stabilizing circuit. FIG. 7 shows a variation of this circuit, in which the non-inverting inputs of amplifiers 3 and 4 are not connected to the cathode but to the anode of the respective diodes $D_5$ and $D_6$.

Figure 8:
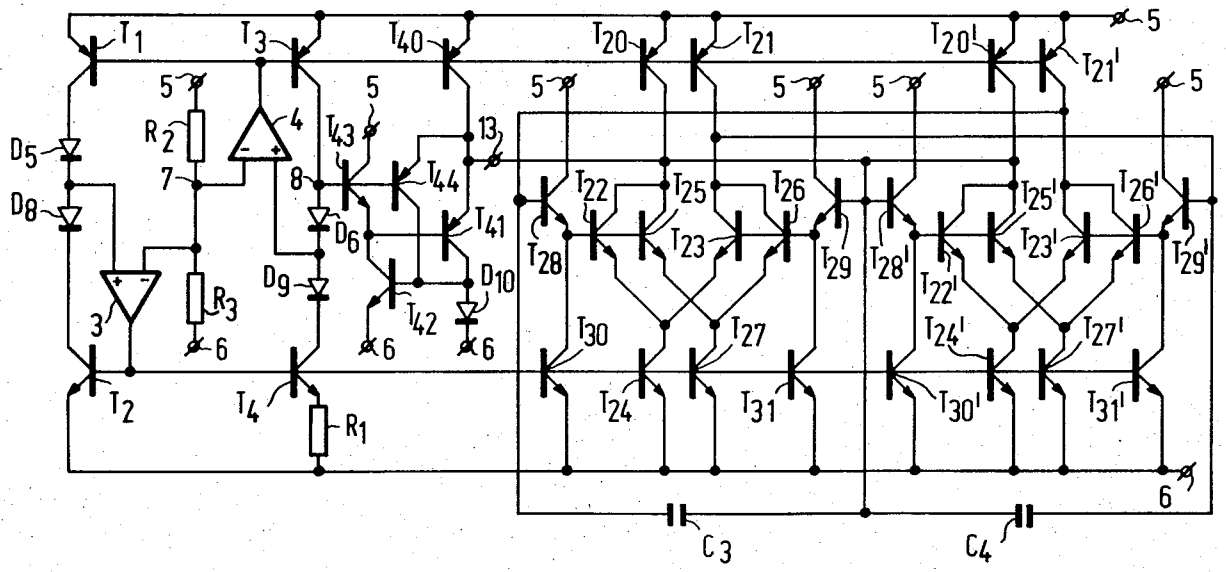
FIG. 8 shows a filter circuit comprising a fourth current stabilizing circuit according to the invention.

FIG. 8 shows a filter circuit comprising a fourth current stabilizer in which components which are the same as in FIG. 4 are given the same reference numerals. This filter circuit differs from the circuit shown in FIG. 4 in that the input transistors of the transconductance circuits comprise emitter follower-connected transistors $T_{28}$ ($T_{28}'$) and $T_{29}$ ($T_{29}'$), current source transistors $T_{30}$ and $T_{31}$ ($T_{30}'$ and $T_{31}'$) being provided in the emitter leads. The output 13 of the negative impedance converter is now coupled to the commonly-connected bases of the transistors $T_{29}$, $T_{28}'$ which are further coupled to the collectors of the transistors $T_{20}$ and $T_{20}'$. The bases of transistors $T_{28}$ and $T_{29}$ are coupled to the respective collectors of the transistors $T_{21}'$ and $T_{21}$. Since the circuit incorporates negative feedback, the bases of the transistors $T_{28}$, $T_{29}$, $T_{28}'$ and $T_{29}'$ carry the same voltages. As a result thereof the collector voltages of the transistors $T_{40}$, $T_{20}$, $T_{21}$, $T_{20}'$ and $T_{21}'$ are equal. There are now two base-emitter junctions, which consume two diode voltages, between the collectors of the transistors $T_{20}$ to $T_{21}'$ and the collectors of the transistors $T_{24}$ to $T_{27}'$.

The first circuit of the current stabilizer comprises two series-arranged diodes $D_5$ and $D_8$, the non-inverting input of the amplifier 3 being coupled to the junction point of the diodes $D_5$ and $D_8$. Similarly the second circuit comprises two series-arranged diodes $D_6$ and $D_9$, the non-inverting input of the amplifier 4 being coupled to the junction point between the diodes $D_6$ and $D_9$. The inverting inputs of the amplifiers 3 and 4 are connected to the junction point 7 between the resistors $R_2$ and $R_3$. It being assumed that the voltages at the two inputs of each of the amplifiers 3 and 4 are equal, it is easy to see that the collector-base voltages of the transistors $T_{20}$, $T_{21}$, $T_{20}'$ and $T_{21}'$ are equal again to the collector-base voltage of the transistors $T_1$ and $T_3$ of the current-stabilizing circuit. In addition, the collector-base voltages of the transistors $T_{24}$, $T_{27}$, $T_{24}'$ and $T_{27}'$ are equal to the collector-base voltages of the transistors $T_2$ and $T_4$.

It should be noted that by incorporating two series-arranged diodes, the current stabilizing circuits shown in the FIGS. 4, 5, 6 and 7 can be used for the filter circuit shown in FIG. 8.

Figure 9:
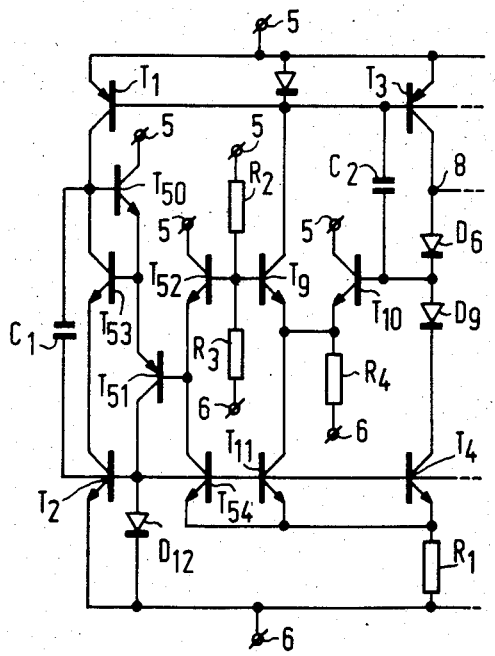
FIG. 9 shows a practical implementation of the current stabilizing circuit shown in FIG. 8.

FIG. 9 shows a practical implementation of a current stabilizing circuit as shown in FIG. 8, components identical to those in FIG. 3 having been given the same reference numerals. The construction of the differential amplifier 4 is in all respects the same as that of the amplifier shown in FIG. 3. In this embodiment the amplifier 3 is constituted by an NPN-transistor $T_{50}$ which forms an amplifier in combination with PNP-transistor $T_{51}$. The base of transistor $T_{50}$ is coupled to the first current circuit and the collector of this transistor is connected to the positive supply terminal 5. The base current of transistor $T_{50}$ is compensated for by the base current of a transistor $T_{53}$, whose collector-emitter path is provided in the first current circuit. There are thus two base-emitter junctions between the collectors of the transistors $T_1$ and $T_2$, so that the two diodes need not be provided individually. The base of transistor $T_{51}$ is driven by an emitter follower-connected transistor $T_{52}$, a current source constituted by transistor $T_{54}$ whose emitter lead comprises the resistor $R_1$ being incorporated in the emitter lead. The collector of transistor $T_{51}$ is coupled to the negative supply terminal 6 via a diode $D_{12}$ whose anode is connected to the commonly-connected control electrodes of the transistors $T_2$ and $T_4$.

What is claimed is:

1. A current stabilizing circuit comprising first and second common terminals, and first and second circuits arranged in parallel between said first and second common terminals, the first circuit being formed by the series arrangement of the collector-emitter path of a first transistor of a first conductivity type and the collector-emitter path of a second transistor of a second conductivity type, the second circuit being formed by the series arrangement of the collector-emitter path of a third transistor of the first conductivity type, the collector-emitter path of a fourth transistor of the second conductivity type and a resistor, a first differential amplifier having a first and a second input and an output, the first and third transistors having commonly-connected control electrodes and the second and fourth transistors having commonly-connected control electrodes which are driven by an output of said first differential amplifier, the first input of said first differential amplifier being coupled to the first circuit between the first and second transistors, and a second differential amplifier having a first and a second input and an output, the commonly-connected control electrodes of the first and third transistors being driven by an output of said second differential amplifier, the first input of said second differential amplifier being coupled to the second circuit between the third and fourth transistors, a voltage divider having a tap and being provided between the first and second common terminals and the second inputs of the first and second differential amplifiers being coupled to said tap of the voltage divider.

2. A current stabilizing circuit as claimed in claim 1, characterized in that in at least the first and second circuits between the collector-emitter paths of respectively the first and second transistors and the third and fourth transistors a semiconductor junction is provided which is connected in the forward direction.

3. A current stabilising circuit as claimed in claim 2, the voltage divider being formed by the series arrangement of a second and a third impedance, characterized in that the voltage divider also comprises at least one semiconductor junction connection in the forward direction and arranged between the second and third impedances.

* * * * *